United States Patent [19]

Kline et al.

[11] 4,139,921

[45] Feb. 20, 1979

[54] DEVICE FOR CLEANING FLOATER OVEN NOZZLES

[75] Inventors: James L. Kline, Mount Joy; Clyde B. Wissler, Brownstown, both of Pa.

[73] Assignee: Armstrong Cork Company, Lancaster, Pa.

[21] Appl. No.: 904,612

[22] Filed: May 10, 1978

[51] Int. Cl.[2] ..... A46B 13/02

[52] U.S. Cl. ..... 15/21 E; 34/85; 432/2

[58] Field of Search ..... 15/21 R, 21 E, 40, 77; 432/2; 34/85, 156

[56] References Cited

U.S. PATENT DOCUMENTS 2,178,963 11/1939 Habstritt ..... 15/21 E X

FOREIGN PATENT DOCUMENTS 1535879 7/1968 France ..... 15/21 E

*Primary Examiner*—Edward L. Roberts

[57] ABSTRACT

A device for cleaning the nozzle openings of a floater oven having duct-like nozzles with rows of nozzle openings along their length. A main frame which may be disposed adjacent to the oven nozzles is provided as a support structure. A main carriage adapted to travel back and forth along the length of the main frame is slidably mounted on the frame. A set of brushes adapted to be driven in rotation are mounted on the main carriage so they may be positioned in contact with the nozzle openings to be cleaned. In operation, the main frame is located adjacent to an oven nozzle. The main carriage is transported along the main frame as the brushes are rotated. The brushes automatically clean the nozzle openings along the nozzle.

7 Claims, 9 Drawing Figures

DEVICE FOR CLEANING FLOATER OVEN NOZZLES

BACKGROUND OF THE INVENTION

The present invention relates to devices for accomplishing the cleaning of nozzle openings and, more particularly, to devices for use in cleaning the nozzle openings of floater ovens.

In the production of sheet materials floater ovens are often used to dry and cure various coatings. Floater ovens use high velocity streams of hot air to suspend a web of the material to be treated in the oven and to provide the necessary heat for curing and drying. These high velocity air streams are produced by passing air through a series of dryer nozzles manufactured with small nozzle openings along their length. Ordinarily the nozzles are disposed transverse to the flow of the web of material through the oven and are placed both above and below the passageway in the oven through which the material flows. The nozzle openings are positioned in rows along the length of the bottom of the top nozzles and the top of the bottom nozzles. During the curing and drying process, solvents from the sheet materials are oxidized, become charred, and collect as air is recycled through the system. These products of combustion can build up and clog the nozzle openings, reducing or stopping air flow, and necessitating shutting down and cleaning of the nozzles. In the past, this cleaning process has been accomplished through time consuming and expensive hand operations in the course of which the nozzles were completely removed from the oven.

Accordingly, it is a principle object of the present invention to provide a nozzle cleaning device for floater ovens which will automatically accomplish its cleaning function with a minimum of manual assistance.

It is another object of the present invention to provide a nozzle cleaning device for floater ovens which can operate to clean the nozzles in place within the oven.

It is a further object of the present invention to provide a nozzle cleaning device which will thoroughly, accurately, and speedily clean the nozzle openings of a floater oven and which is simple in construction, durable in use, efficient in operation, and otherwise well adapted to the purposes for which the same is intended.

SUMMARY OF THE INVENTION

A device for use in cleaning the nozzle openings of a floater oven of the type wherein a set of duct-like nozzles having rows of nozzle openings along their length are disposed transverse to the direction of material flow through the oven and above and below the passageway for flow of material in the oven. A main frame, adapted to be positioned adjacent to an oven nozzle in the passageway through the oven, is provided as a support structure. A main carriage is slidably mounted on the main frame and attached to a motor powered chain drive, also mounted on the main frame, and adapted to transport the carriage back and forth along the length of the main frame. A brush assembly, including a set of brushes and a brush motor which drives the brushes in rotation during operation of the device, is mounted on the main carriage. The brush assembly is mounted so as to provide that the brushes may be located directly over the nozzle openings intended to be cleaned. In operation, the main frame is positioned adjacent to an oven nozzle. The main carriage is transported along the length of the main frame. The brushes contact the nozzle openings along the length of the nozzle and clean out the openings by friction induced by their rotation. Additionally, a nozzle follower assembly, including a follower wheel adapted to center itself and the follower assembly over a nozzle during operation of the device, may be mounted on the main frame together with the brush assembly to form a secondary carriage. This secondary carriage is specially attached to the main carriage so as to leave the secondary carriage free to float transverse to the direction of main carriage travel in coordination with movements of the nozzle follower assembly. The secondary carriage is thereby kept centered over the nozzle to be cleaned and the brushes are thereby maintained in alignment with the nozzle openings.

DESCRIPTION OF THE PREFERRED EMBODIMENT

Figure 1:
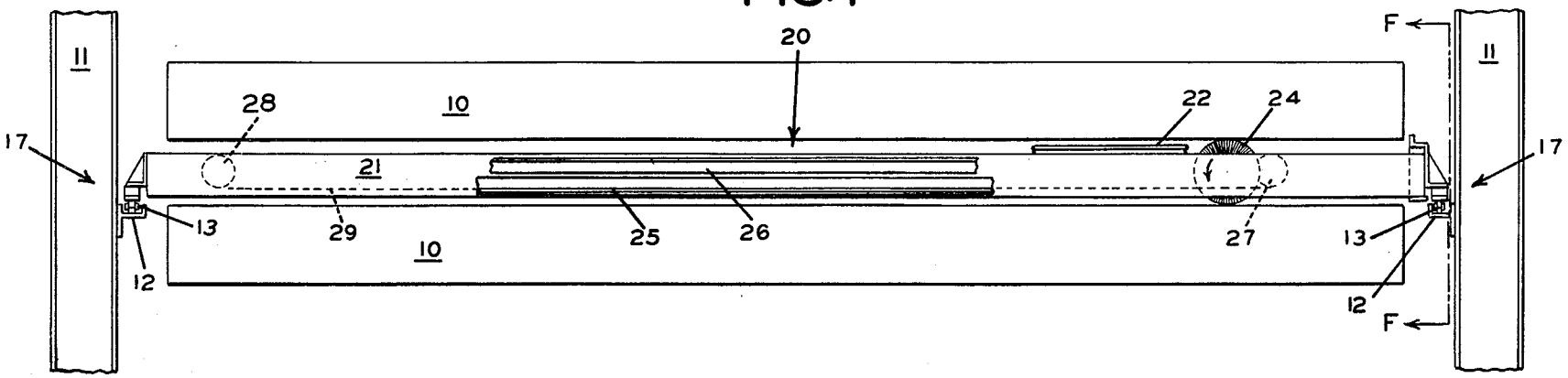
FIG. 1 shows a side view partially broken away of the present invention disposed within a floater oven in an operating position.
Figure 4:
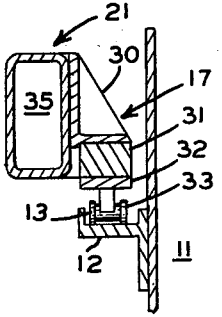
FIG. 4 shows an expanded sectional view, along lines E—E of FIG. 3, of the means for moving the present invention in the oven, additionally showing selected oven components.
Figure 2:
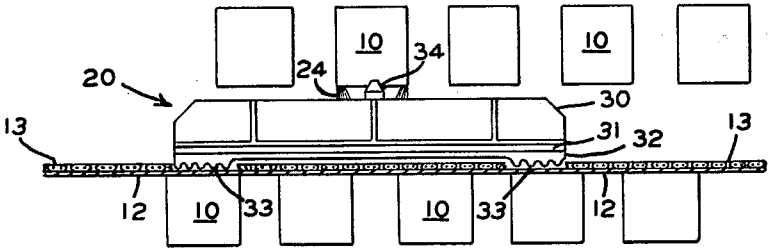
FIG. 2 shows a sectional end view, along lines F—F of FIG. 1, of the present invention disposed within a floater oven in an operating position.

Referring now to the figures wherein like reference characters refer to like or corresponding parts throughout the several views, FIGS. 1 and 2 show a side and end view, respectively, of a nozzle cleaning device 20 disposed for operation in a floater oven. The floater oven includes nozzles 10, walls 11, tracks 12, and conveyor chains 13. Nozzles 10 are located above and below a passageway for material through the oven and are located between walls 11. Tracks 12 are secured to walls 11. Conveyor chains 13 are powered to move longitudinally through the oven in tracks 12. Nozzle cleaning device 20 includes main frame 21, main carriage 22, brushes 24, tracks 25 and 26, sprockets 27 and 28, chain 29, and cleaner moving means 17. Main carriage 22 is slidably mounted on main frame 21. Brushes 24 are attached to the main carriage 22. The main carriage 22 is also connected to chain 29 which runs in tracks 25 and 26 and around sprockets 27 and 28. Chain 29 is adapted to transport main carriage 22 back and forth along main frame 21. FIG. 4 shows a detailed view of one cleaner moving means 17 for moving the nozzle cleaning device 20 through the oven. Cleaner moving means 17 comprises support bracket 30, support strip 31, and engaging strip 32. Support bracket 30 is secured to end member 35 of main frame 21. Support strip 31 is attached to the bottom of bracket 30 and forms a base for engaging strip 32. Engaging strip 32 has teeth 33 which engage chains 13 in tracks 12. In operation, nozzle cleaning device 20 is transported by cleaner moving means 17 which engage chains 13 which chains may be controlled to travel forward and back through the oven. The nozzle cleaning device 20 is moved until it is centered over a particular nozzle as determined by the location of position indicator 34 attached to the main frame. The operation of the device 20 is then started. Brushes 24 are driven in rotation. Main carriage 22 and brushes 24 attached thereto are transported along the length of main frame 21. The brushes 24 contact the nozzle openings in the nozzle and clean the nozzle openings along the length of the nozzle.

Figure 3:
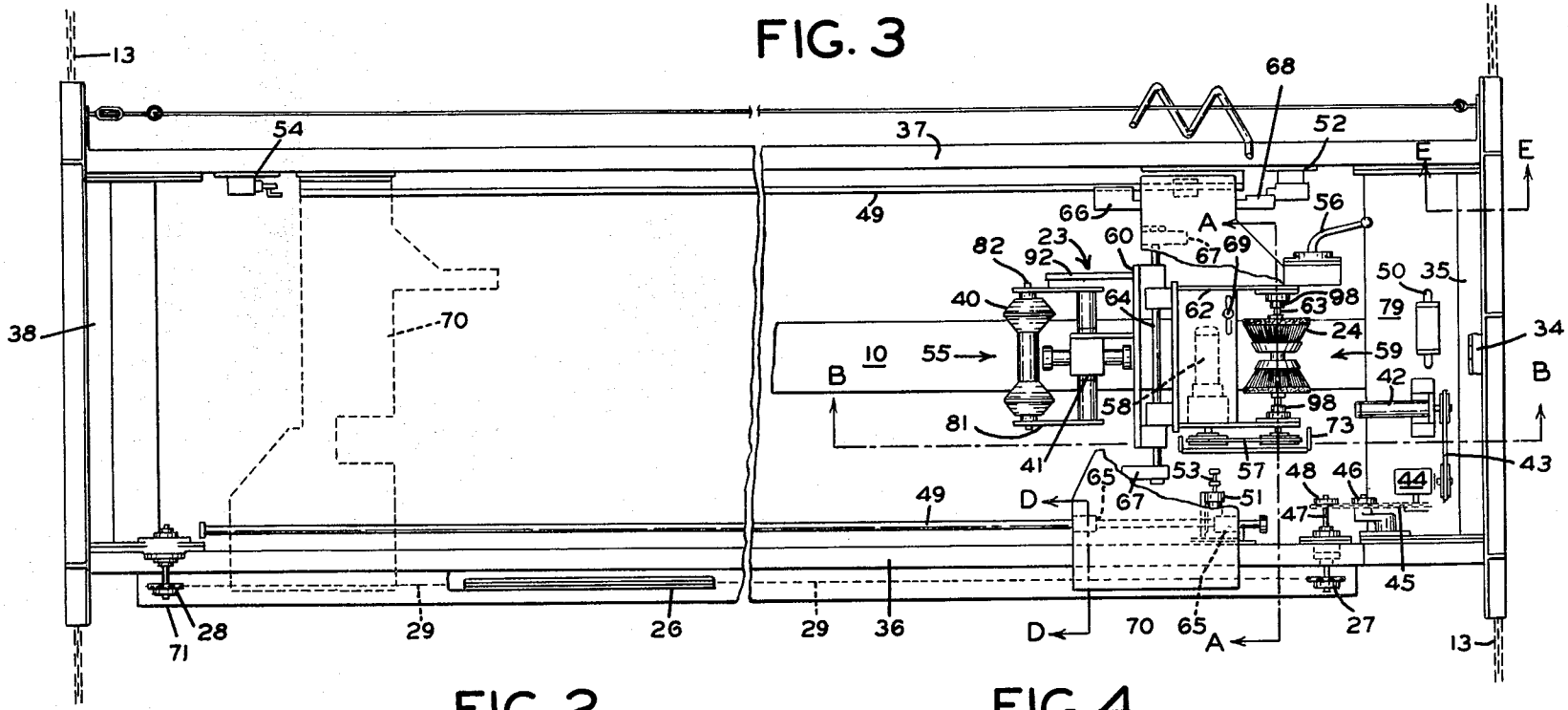
FIG. 3 shows a top view partially broken away of the present invention centered over an oven nozzle in operating position.
Figure 7:
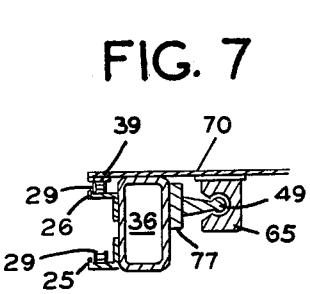
FIG. 7 shows an expanded sectional view, along lines D—D of FIG. 3, of the means by which the present invention is mounted on the main frame.

FIG. 3 shows a detailed top view of a nozzle cleaning device 20 centered over a nozzle 10. Main frame 21 comprises side members 36 and 37 and end members 35 and 38. Cleaner moving means 17 is secured to the end members 35 and 38 of the main frame 21. Main carriage 22 including cover plate 70 (partially broken away), axle supports 67, sliding supports 65, axle 64, cams 66 and 68, and actuator valve 56 is slidably mounted on main frame 21. Sliding supports 65 engage rods 49 attached to the side members 36 and 37 of main frame 21 and thereby provide the mounting for the main carriage 22 on the main frame. FIG. 7 shows a detailed view of the arrangement of the side members, rods, and sliding supports. Rod 49 is attached to side member 36 by bracket 77. Sliding support 65 slip fits on rod 49. Cover plate 70 is secured to sliding support 65 and is attached to chain 29 by link 39. The main carraige 22 is transported along the main frame 21 through the sliding action of supports 65 on rods 49 in response to movements of chain 29 in tracks 25 and 26 and around sprockets 27 and 28. The chain 29 and sprockets 27 and 28 are protected by shielding plates 71. Chain 29 is driven by sprocket 27 secured on axle 47 which is attached to and extends through frame member 36 to sprocket 48. Sprocket 48 is driven by chain 45 which runs over idler 46 from gearbox 44. Gearbox 44 is driven by air motor 42 by means of belt 43. Gearbox 44 is a conventional gearbox providing, for example, a 10 to 1 rotary speed reduction. Air motor 42 is a conventional reversible air motor providing 250 rpm, 0.18 hp output at 90 psi, 14 cfm of supply air in this illustrative embodiment. Idler 46 is mounted on side member 36 of frame 21. Gearbox 44 and air motor 42 are secured to plate 79 which is attached to the frame 21. Valve 50 is a two position, four way, double air pilot with detent valve which functions as the main operating valve for the nozzle cleaning device. Valve 52 is a two position, four way, cam actuated, spring return valve which functions to shut down operation of the nozzle cleaning device when the main carriage returns to its beginning position during operation of the present invention. Valve 54 is a two position, three way, cam actuated, spring return valve which functions to reverse the direction of movement of the main carriage on the main frame when the main carriage reaches the end of the main frame opposite its starting position during operation of the present invention. Valves 52 and 54 are secured to opposite ends of member 37 of main frame 21 at positions where they can be activated by cams 66 and 68 on main carriage 22. Valve 56 is a four way, manual operating, locking type valve which functions to control the position of follower wheel 40 locking it in either an up or down position. Regulator 76 (not shown) is connected to valve 56 and controls air supply pressure to the rotary actuator 41.

Figure 6:
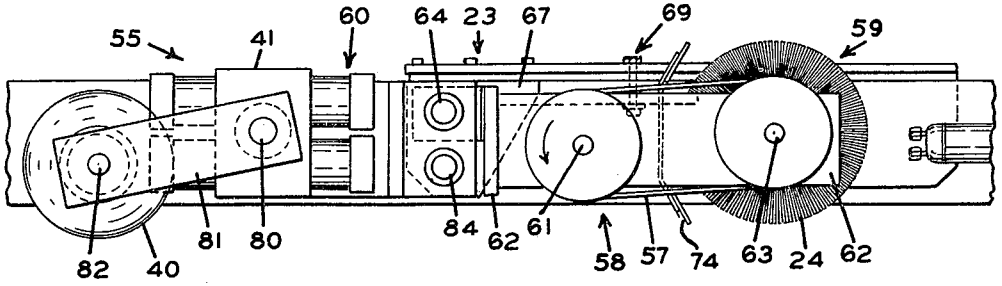
FIG. 6 shows an expanded sectional view, along lines B—B of FIG. 3, of the secondary carriage assembly of the present invention.
Figure 5:
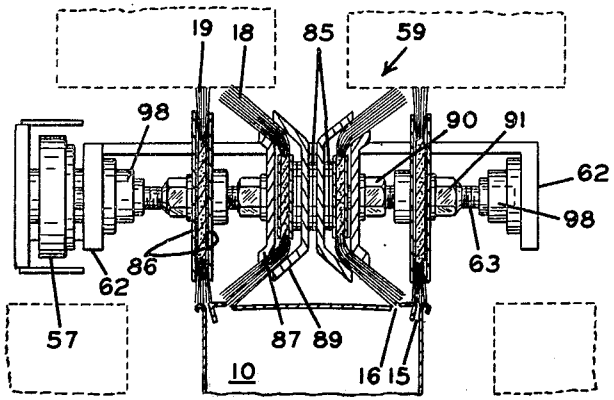
FIG. 5 shows an expanded sectional view, along lines A—A of FIG. 3, of the brush assembly of the present invention centered over an oven nozzle in operating position.

Referring now to FIGS. 3, 5, and 6, follower wheel 40 is a solid plastic, dog-bone shaped wheel mounted on axle 82, which axle is secured on bearings in toggle 81. Toggle 81 is secured to the shaft 80 of rotary actuator 41 which, in response to signals from valve 56, maintains the follower wheel 40 in either its up or down position. Spring centering unit 92 coupled to toggle 81 and frame 60 is used to support follower wheel 40 in mid-position when the rotary actuator 41 is not in operation, specifically during transport of the cleaning device 20 into and through the oven. The rotary actuator 41 is attached to frame 60 which is mounted on axles 64 and 84 connected to the main carriage by axle supports 67. The nozzle follower assembly 55, including frame 60, rotary actuator 41, toggle 81, and wheel 40, is free to float from side to side on axles 64 and 84 transverse to the direction of travel of main carriage during operation of the present invention. Brushes 24 are mounted on axle 63 which is secured on bearings 98 in toggle 62. Axle 63 and brushes 24 are driven in rotation by air motor 58 which is a conventional non-reversing pneumatic motor attached to the toggle 62 and providing 1.25 hp, 900 rpm output at 90 psi, 40 cfm of supply air in this illustrative embodiment. Power is delivered to the brushes 24 by belt 57 running over pulleys on axle 63 of brushes 24 and the shaft 61 of motor 58. Toggle 62 is mounted on shaft 64 immediately inside of and interlocked with the connections of frame 60 on the axle 64. The brush assembly 59, including the brushes 24, is free to float up or down normal to the plane of the main frame 21. The nozzle follower assembly 55 and brush assembly 59 mounted together on axle 64 comprise the secondary carriage 23. Since the toggle 81 is transversely interlocked with frame 60 on shaft 64, the secondary carriage 23 and the brush assembly 59 are forced to track the transverse movements of the nozzle follower assembly 55 on shaft 64. In operation, during travel of the main carriage 22, the follower wheel 40 centers itself and the entire secondary carriage 23 over the nozzle being cleaned. The brushes 24 are thereby centered with respect to the nozzle and maintained in contact and alignment with the nozzle openings during transport of the main carriage 22. Bolt 69 connects the toggle 62 to the cover plate 70 and prevents the brushes 24 from descending below the plane of the main frame 21. The air cylinder 51 acts to center the secondary carriage 23 on the axle 64 by pushing against the belt cover plate 73 of the brush assembly 59. Shield 74 protects the motor 58 from dust produced by the operation of the brushes 24.

FIG. 5 shows a detailed end view of the brush assembly 59 positioned over a nozzle 10. Nozzle 10 includes outer vertical slot openings 15 and inner slanting slot openings 16 which it is the purpose of the present invention to clean. Inner brushes 18 are clamped between inner cones 89, outer cones 87, and washers 85 so that they project directly into slanting openings 16. Outer brushes 19 are clamped between washers 86 so as to project directly into vertical openings 15. Nuts 90 and 91 hold the washers and cones in position. Brushes 18 and 19 preferably include wire bristles.

Figure 8:
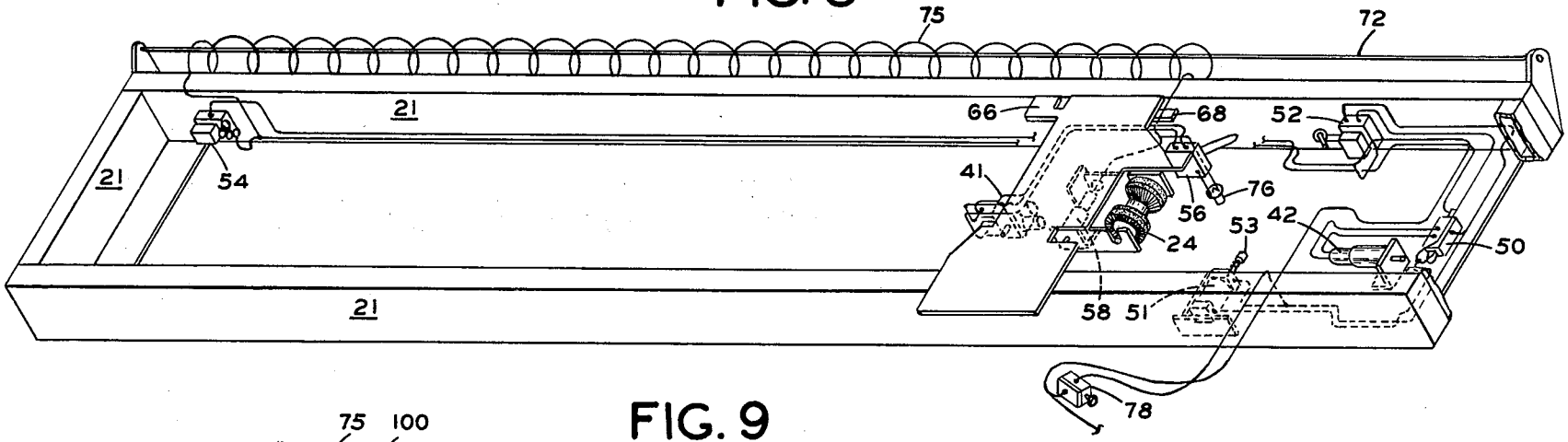
FIG. 8 shows a simplified prospective view of the present invention, including pneumatic components and connections.
Figure 9:
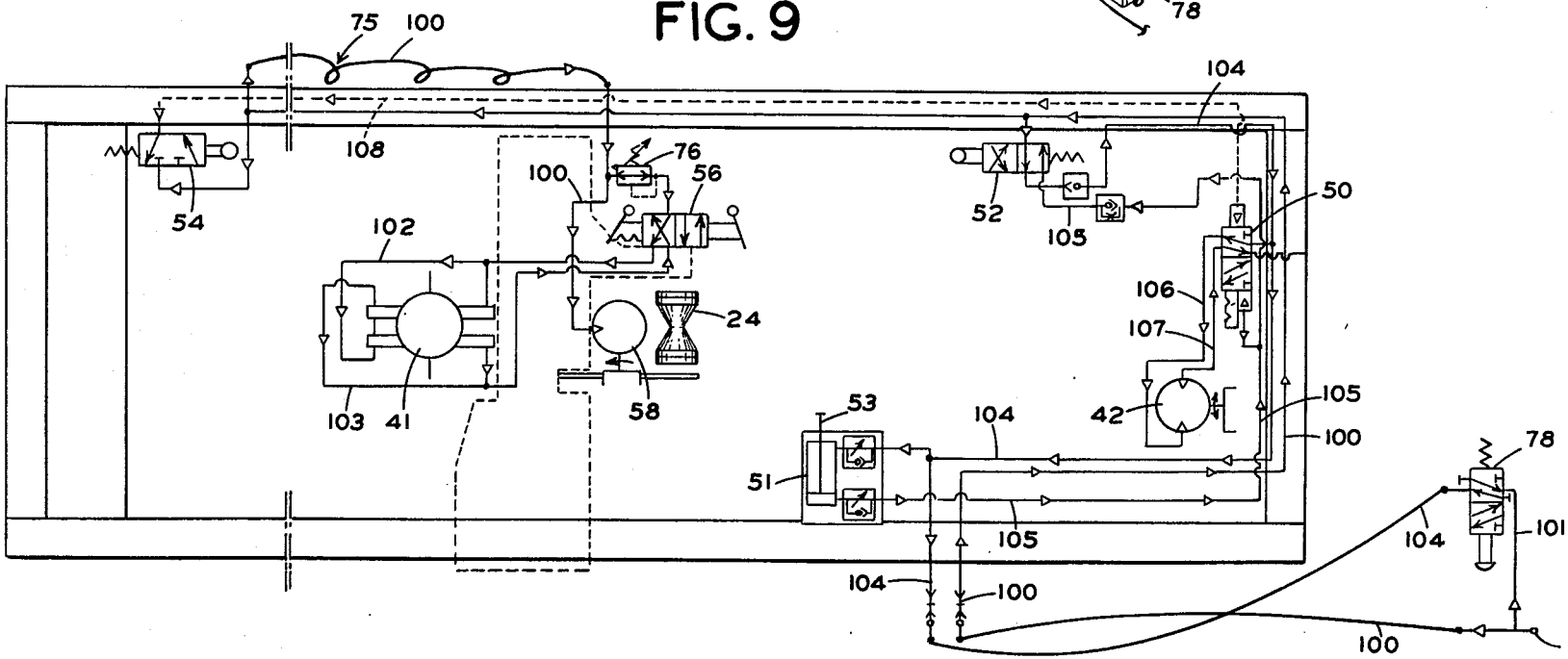
FIG. 9 shows a complete diagram of the pneumatic components and connections in the present invention.

FIGS. 8 and 9 illustrate the pneumatic system of the present invention with the main carriage 22 having traveled part way down the main frame 21. Flexible coupling hose 75 suspended on cable 72 forms the pneumatic connection between the main frame 21 and main carriage 22. Hand valve 78 is a two position, four way, spring return, manual operating valve which functions to start the travel of the main carriage after the nozzle cleaning device has been properly positioned and line 100 has been connected to a suitable source of supply air. Supply air should preferably be provided for the operation of the present invention at 80 psi with a flow capacity of 40 cfm. In operation, the oven conveyor chain 13 is manipulated in order to position the nozzle cleaning device 20 transported thereon relative to a nozzle to be cleaned. Spring unit 92 maintains the follower wheel 40 in mid-position where it cannot interfere with travel of the cleaning device 20. Indicator 34 is used to determine when the device is properly centered. Line 100, which includes flexible coupling hose 75 as a part thereof, is then connected to a source of suitable supply air and is pressurized thereby activating brush motor 58 and rotary actuator 41 through regulator 76 and valve 56. Regulator 76 serves to control the pressure of the air supplied to the actuator 41 which, in turn, determines the force with which wheel 40 is maintained in position. Valve 56 controls the direction of air flow in lines 102 and 103 which determines the position, up or down, in which wheel 40 will be maintained by the actuator 41. When not in operation, main carriage 22 is disposed in its stationary position with cam 68 impinging on valve 52. When hand valve 78 is activated, line 104 is pressurized by way of line 101 connected to line 100, causing the retraction of rod 53 by air cylinder 51. Simultaneously, air is supplied through control valve 50 and line 106 connected therewith to main carriage motor 42 which begins turning over and moving the main carriage away from valve 52. The secondary carriage 23 centers itself over the nozzle being cleaned. The brushes 24 are thereby aligned in contact with the nozzle openings which are cleaned by the rotating action of the brushes. After the main carriage has traveled a short distance, cam 68 is withdrawn from the lever of valve 52 and line 100 is connected to line 104, which connection provides a steady source of supply air to motor 42 independent of valve 78. When the carriage reaches the valve 54, cam 66 impinges on the valve lever and line 100 is connected to line 108 which provides an air signal to control valve 50. In response, control valve 50 connects line 100 to line 107, instead of line 106. The direction of rotation of motor 42 is thereby reversed, and the main carriage is driven back toward valve 52. When the main carriage reaches the valve 52, the cam 68 impinges on the valve lever disconnecting the air supply to the motor 42 through the control valve 50. Line 105 is connected to line 100, the control valve 50 is reset to connect line 104 to line 106. Rod 53 is pushed out by air cylinder 51 centering the secondary carriage 23. The nozzle cleaning device may be completely shut down by disconnecting the line 100 from the main air supply. The nozzle cleaning device may then be centered over another nozzle and operations begun again. The valve 56 may be switched to provide for the cleaning of nozzles above or below the cleaning device.

Various modifications and alterations will readily occur to those skilled in the art without departing from the spirit and scope of the invention as defined in the appended claims. It is intended, therefore, that the embodiment shown and described herein be considered as exemplary only and not in a limiting sense.

We claim:

1. A nozzle cleaning device for use in cleaning the nozzle openings of a floater oven of the type wherein a set of nozzles comprising ducts having nozzle openings along their length are disposed traverse to the direction of material flow through the oven and above and below the passageway for flow of material in the oven, said device comprising:

(a) a main frame adapted to be transported in the passageway between the upper and lower nozzles of said oven;

(b) moving means for transporting said main frame through said passageway in the direction of material flow through the oven;

(c) a main carriage slidably mounted on said main frame and adapted to travel along the length of a nozzle of said oven transverse to the direction of material flow through the oven;

(d) a main carriage motor for driving said main carriage along the length of said nozzle;

(e) a brush assembly mounted on said main carriage including a set of brushes adapted to be driven in rotation and positioned so as to contact the nozzle openings of said nozzle as the main carriage travels along the nozzle; and (f) a brush motor for driving said brushes in rotation.

2. The device of claim 1, further comprising a nozzle follower assembly including a follower wheel mounted together with said brush assembly to form a secondary carriage adapted to center itself on said nozzle and guide said brushes so that the brushes remain in contact with the nozzle openings of said nozzle as the main carriage travels along the length of the nozzle.

3. The device of claim 2, wherein said set of brushes comprise a pair of outer disc type wire brushes for cleaning vertical slot nozzle openings and a pair of inner cupped wire brushes for cleaning slanting slot nozzle openings.

4. The device of claim 2, wherein said main carriage motor and said brush motor are pneumatically powered.

5. The device of claim 4, further including:

(a) a rotary actuator for positioning said nozzle follower in either an up or down position so that said follower may center on a nozzle above or below the passageway for flow of material in the oven and (b) an actuator valve for controlling said rotary activator and locking said nozzle follower in either an up or down position.

6. The device of claim 5, further including an air cylinder secured to said main frame for positioning said secondary carriage assembly with respect to said main frame.

7. The device of claim 6, further including:

(a) a first cam activated valve positioned at one end of the main frame adapted to be operated by the main carriage when it reaches the limit of its travel approaching said first cam activated valve;

(b) a second cam activated valve positioned at one end of the main frame opposite said first cam activated valve adapted to be operated by the main carriage when it reaches the limit of its travel approaching said second cam activated valve;

(c) a main valve connected to said main carriage motor, said first cam activated valve, said second cam activated valve, said actuator valve, said brush motor, and said air cylinder, said main valve operably for controlling said main carriage motor, said actuator valve and rotary actuator, said brush motor, and said air cylinder; and (d) a control valve connected to said first cam activated valve, said second cam activated valve, said actuator valve, said brush motor, and said air cylinder for engaging the operation of the nozzle cleaning device.

* * * * *